US006666550B2

(12) United States Patent
Sasaki

(10) Patent No.: US 6,666,550 B2
(45) Date of Patent: Dec. 23, 2003

(54) INK CARTRIDGE

(75) Inventor: Toyonori Sasaki, Anjyo (JP)

(73) Assignee: Brother Kyogo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/155,975

(22) Filed: May 29, 2002

(65) Prior Publication Data

US 2003/0001933 A1 Jan. 2, 2003

(30) Foreign Application Priority Data

Jun. 28, 2001 (JP) ..... 2001-195978

(51) Int. Cl.[7] ..... B41J 2/175
(52) U.S. Cl. ..... 347/85; 347/87
(58) Field of Search ..... 347/84, 85, 86, 347/87

(56) References Cited

U.S. PATENT DOCUMENTS 4,794,409 A * 12/1988 Cowger et al. ..... 347/87
6,010,212 A * 1/2000 Yamashita et al. ..... 347/86
6,074,051 A 6/2000 Sasaki
6,120,139 A * 9/2000 Childers et al. ..... 347/92
6,270,207 B1 8/2001 Sasaki
6,347,863 B1 * 2/2002 Yuen ..... 347/85
6,511,166 B2 * 1/2003 Smith et al. ..... 347/85

* cited by examiner

*Primary Examiner*—Anh T. N. Vo
(74) *Attorney, Agent, or Firm*—Oliff & Berridge, PLC

(57) ABSTRACT

An ink cartridge for storing ink to be supplied to an ink-jet head includes a porous member that absorbs the ink, a porous member storage chamber that accommodates a porous member therein, and an ink chamber that stores the ink supplied from the porous member. The inside of the ink cartridge is separated into the ink chamber and the porous member storage chamber by side partition walls and a bottom partition wall. The bottom partition wall has a connecting hole that connects the porous member storage chamber and the ink chamber to each other. The opening of the connecting hole is noncircular in horizontal cross-section. Accordingly, the connecting hole is not occluded by an air-bubble trapped in the ink, so that the ink absorbed by the porous member and the ink stored in the ink chamber can be always be in contact with each other via the connecting hole.

24 Claims, 5 Drawing Sheets

INK CARTRIDGE

BACKGROUND OF THE INVENTION

1. Field of Invention

The invention relates to an ink cartridge for storing ink therein to be supplied to an ink-jet head of an ink-jet recording device.

2. Description of Related Art

U.S. Pat. No. 6,270,207 B1 discloses an ink cartridge that includes a case having therein side partitioning walls and a bottom partitioning wall to divide the inside of the case into a first ink chamber, a second ink chamber and an atmosphere connection chamber. In the ink cartridge, the bottom partition wall has a connecting hole that connects the first chamber and the second chamber to each other. The opening of the connecting hole is circular in horizontal cross-section.

U.S. Pat. No. 6,074,051 discloses an ink cartridge that includes a cartridge case having a partition which partitions the cartridge case interior into an ink chamber and a storage chamber. The ink chamber contains ink, and the storage chamber contains a member impregnated with ink. The partition has an ink passage formed through it at its bottom to connect the ink chamber and the storage chamber.

SUMMARY OF THE INVENTION

The invention provides an ink cartridge wherein blocking of a connecting hole, which connects a porous member storage chamber and an ink chamber, by an air-bubble, is prevented, thereby effectively preventing ink leakage from an ink-jet head.

According to one aspect of the invention, an ink cartridge for storing ink to be supplied to an ink-jet head, includes a case having a partition therein for dividing an inside of the case into a first chamber and a second chamber, and a porous member is accommodated in the first chamber and impregnated with the ink. In the ink cartridge, the partition wall has a connecting hole that passes through the partition wall in a gravity direction when printing is performed by the ink-jet head. The connecting hole connects the first chamber and the second chamber in the gravity direction. The opening of the connecting hole has noncircular cross-section in a direction perpendicular to the gravity direction.

With this structure, the connecting hole is prevented from being closed by an air-bubble, so that ink stored in the first chamber and ink stored in the second chamber can always be in contact with one another. Accordingly, the ink in the ink chamber can be absorbed by the porous member at all times. Consequently, ink leakage from the ink-jet head can be effectively prevented.

BRIEF DESCRIPTION OF THE DRAWINGS

Exemplary embodiments of the invention will be described in detail with reference to the drawings wherein.

DETAILED DESCRIPTION OF PREFERRED EMBODIMENTS

Figure 1:
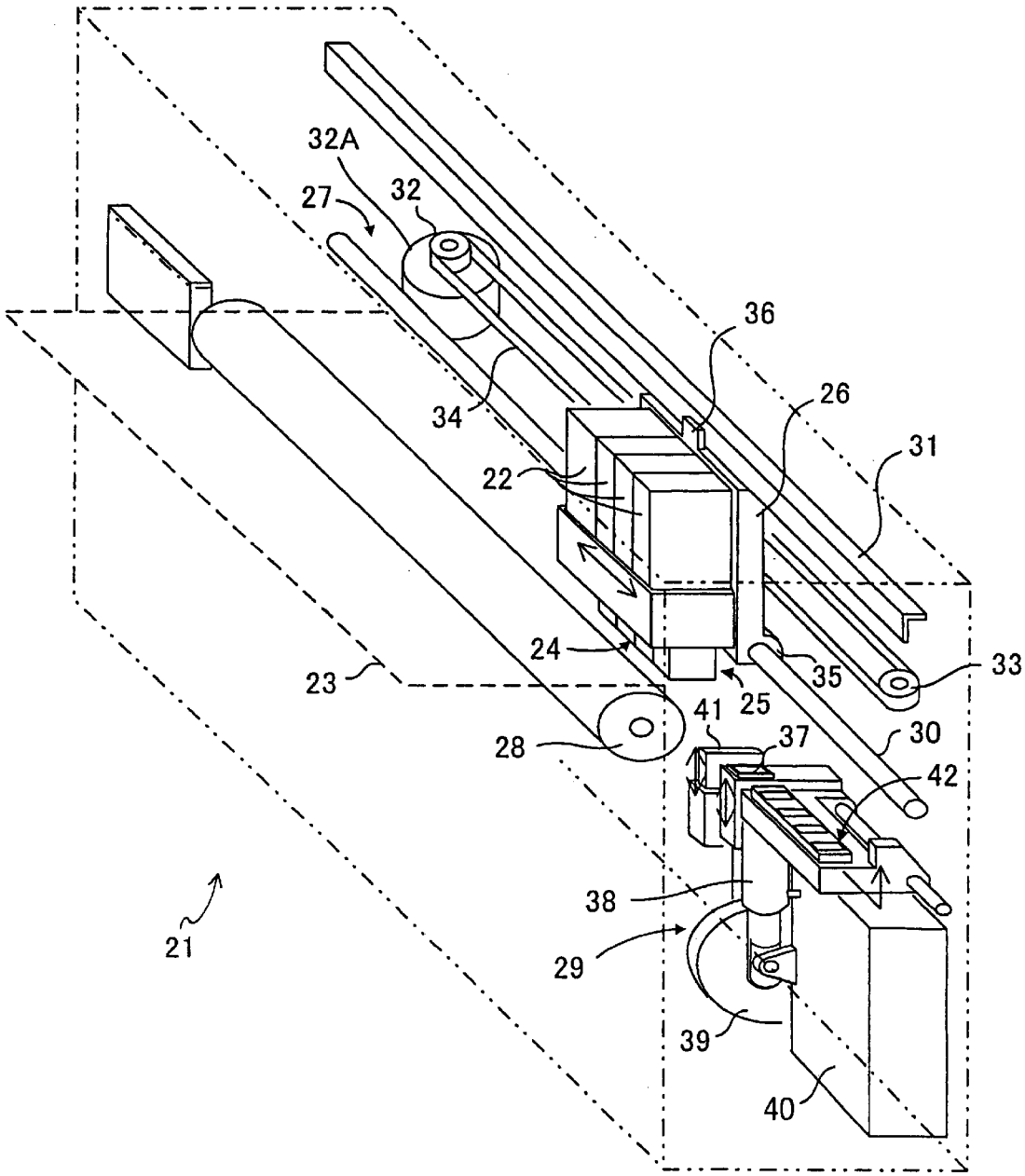
FIG. 1 is a perspective view showing an embodiment of a color ink-jet printer.

Exemplary embodiments of the invention will be described with reference to the accompanying drawings. As shown in FIG. 1, the exemplary color ink jet printer 21 includes four ink cartridges 22 (although there could be more or less ink cartridges 22), an ink-jet head 24, a head unit 25, a carriage 26, a drive unit 27, a platen roller 28, and a purge device 29. The ink cartridges 22 are each filled with a particular color of ink, such as cyan, magenta, yellow and black. The ink-jet head 24 performs printing using the color inks on a recording medium 23, such as a recording sheet. The ink-jet head 24 is provided on the head unit 25. The ink cartridges 22 and the head unit 25 are mounted on the carriage 26. The drive unit 27 reciprocates the carriage 26 in a straight line. The platen roller 28 extends in a carriage reciprocating direction and faces the ink-jet head 24.

The drive unit 27 includes a carriage shaft 30, a guide plate 31, two pulleys 32, 33 and an endless belt 34. The carriage shaft 30 is disposed at a lower end of the carriage 26 and extends in a direction parallel to the platen roller 28. The guide plate 31 is disposed at an upper end of the carriage 26 and extends in a direction parallel to the carriage shaft 30. The pulleys 32, 33 are disposed at both ends of the carriage shaft 30, between the carriage 26 and the guide plate 31. The endless belt 34 is stretched between the pulleys 32 and 33.

A carriage shaft support portion 35, into which the carriage shaft 30 is inserted, and a guide plate contact portion 36, which can abut against the guide plate 31, are provided at the lower and upper end portions of the carriage 26, respectively. The endless belt 34 is connected with a rear surface of the carriage 26.

As the pulley 32 is rotated in normal and reverse directions by a carriage motor 32A, the carriage 26 connected to the endless belt 34 reciprocates in the straight line, along the carriage shaft 30 and the guide plate 31, according to the rotation in the normal and reverse directions of the pulley 32.

The recording medium 23 is fed from a sheet cassette (not shown) provided in a side or a lower part of the color ink jet printer 21. The recording medium 23, fed from the sheet cassette, is fed between the ink-jet head 24 and the platen roller 28 to perform printing on the recording medium 23 by ink droplets ejected from the ink-jet head 24. Then, the recording medium 23 is discharged from the color ink jet printer 21. In FIG. 1, the sheet feeding mechanism and the discharging mechanism for the recording medium 23 are omitted.

A purge device 29 is disposed next to the platen roller 28. When the head unit 25 is in a reset position, the purge device 29 is opposed to the ink-jet head 24. The purge device 29 serves to recover a condition of the ink-jet head 24 to prevent the occurrence of an ink ejection failure, caused by a buildup of ink and development of air-bubbles in the ink-jet head 24 when ink is first provided to the ink-jet head 24. The purge device 29 includes a suction cap 37, a pump 38, a cam 39 and a waste ink reservoir 42. When the head unit 25 is located in the reset position, the suction cap 37 covers a nozzle surface to cover nozzles (not shown) formed in the ink-jet head 24 to draw ink, including air-bubbles trapped in the ink-jet head 24, using the suction pump 38 activated by the cam 39, thereby purging the ink-jet head 24. The drawn ink is stored in the waste ink reservoir 42.

The ink cartridge 22 includes a substantially rectangular case 51, a top cover 52 that covers the top of the case 51, and a bottom cover 53 that covers the bottom of the case 51.

The case 51 has side outer walls 58, 59, and side partition walls 60, 61 and a bottom partition wall 63 therein. The side partition walls 60, 61 extend in a direction parallel to the side outer walls 58, 59, respectively, at a predetermined distance therefrom. Both upper ends of the side partition walls 60, 61 abut against the top cover 52. The bottom partition wall 63 extends in a direction parallel to the bottom cover 53, so as to bridge between the lower ends of the side partition walls 60, 61, and is provided at a predetermined distance from the bottom cover 53. Therefore, the case 51 has a double-walled structure. A partition wall 64 is provided substantially in the middle of a longitudinal side of the ink cartridge 22, between the bottom partition wall 63 and the bottom cover 64, so as to extend in a direction parallel to the walls 58, 59.

The inside of the case 51 is separated into three areas by partition walls 60, 61, 63 and 64, namely, a porous member storage chamber 55, an ink chamber 56, and an air trap chamber 57. The porous member storage chamber 55 is defined by the top cover 52, the side partition walls 60, 61, and the bottom partition wall 63. The porous member storage chamber 55 accommodates therein a porous member 54 that is made of urethane foam and impregnated with ink.

The ink chamber 56 contains ink therein. The ink chamber 56 includes a space that is defined by the top cover 52, the side outer wall 58 and the side partition wall 60 so as to extend vertically, and a space that is defined by the bottom cover 53, the bottom partition wall 63 and the partition wall 64 so as to extend in a horizontal direction. These spaces are connected to each other.

The air trap chamber 57 is a space for providing air into the porous member storage chamber 55. The air trap chamber 57 includes a space that is defined by the top cover 52, the side outer wall 59 and the side partition wall 61 so as to extend vertically, and a space that is defined by the bottom cover 53, the bottom partition wall 63 and the partition 64 so as to extend in the horizontal direction opposite to the direction of the horizontally extending portion the ink chamber 56.

The bottom partition wall 63 has a connecting hole 65 near the partition wall 64. The connection hole is rectangular in cross section, and connects the porous member storage chamber 55 and the ink chamber 56 with each other. The bottom cover 53 has an ink outlet 67 to supply ink to the ink-jet head 24 from the ink chamber 56.

The bottom cover 53 of the air trap chamber 57 has an air inlet 68, so that the air trap chamber 57 communicates with the outside (the air) via the air inlet 68. The top cover 52 has a communication path 69 to connect the porous member storage chamber 55 and the air trap chamber 57 with each other for the supply of air.

The head unit 25 includes the ink-jet head 24. The ink-jet head 24 is covered with a head cover 81, except for a nozzle surface, and attached to a head holder 71, to which the ink cartridges 22 are attached. The head unit 25 is attached to the carriage 26 via the head holder 71.

The ink-jet head 24 includes an actuator 73 and a manifold 74. The actuator 73 has a plurality of ejection channels 76 for ejecting ink droplets from nozzles. The manifold 74 is connected with the actuator 73 and supplies ink to each of the ejection channels 76 in the actuator 73.

The manifold 74 is made of a resin. In the manifold 74, an ink leading portion 75 and an ink supply portion 78 are integrally formed. The ink leading portion 75 leads ink to the ink supply portion 78 from the ink cartridge 22. The ink supply portion 78 supplies the ink to each of the ejection channels 76 in the actuator 73.

The head holder 71 has a hole 72 in a position opposed to the ink outlet 67 of the ink cartridge 22. A ring-shaped seal member 79, made of an elastic material, is adhesively fixed in the hole 72.

The ink leading portion 75 of the manifold 74 is inserted in the seal member 79. Thus, the ink leading portion 75 is connected with the ink outlet 67 of the ink chamber 56 via the seal member 79.

A base plate 80 made of a metal material is interposed between the head holder 71 and the ink leading portion 75. The base plate 80 is used to determine a reference position of the ink-jet head 24. The ink supply portion 78 is bonded to the base plate 80, thereby supporting the ink-jet head 24 by the base plate 80. The base plate 80 is bonded to the head holder 71.

Ink contained in the ink chamber 56 of the ink cartridge 22 is supplied to the ink supply portion 78 of the manifold 74 via the ink outlet 67 and the ink leading portion 75. Then, the ink is supplied to the ejection channels 76 of the actuator 73 from the ink supply portion 78. The actuator 73 is, for example, made of a piezoelectric ceramic material. The ink, supplied to the ejection channels 76 of the actuator 73, is ejected from the nozzles when the actuator 73 is deformed so as to reduce its volume therein. When the volume of the actuator 73 is increased, that is, the actuator 73 goes back to its normal state, the ink is drawn into the ejection channels 76 from the ink supply portion 78. By repeating such an operation, printing is performed on a recording sheet.

When the ink-jet head 24 is driven, ink absorbed by the porous member 54 is supplied to the ink chamber 56, via the connecting hole 65, and is stored therein. Then, the ink is supplied to the ink-jet head 24 via the ink outlet 67 of the ink chamber 56 and the seal member 79. At that time, the amount of the ink absorbed by the porous member 54 is reduced by the supply of the ink to the ink-jet head 24. Air, which flowed into the air trap chamber 57 via the air inlet 68, flows into the porous member storage chamber 55 from above via the communication path 69, so that the ink level in the chamber 55 is gradually lowered by air pressure. Thus, ink can be continuously supplied to the ink-jet head 24.

When the ink absorbed by the porous member 54 runs out, the ink stored in the ink chamber 56 is supplied to the ink-jet head 24. As the ink is supplied to the ink-jet head 24, air flows into the ink chamber 56, through the connecting hole 65, from the porous member storage chamber 55. At that time, the air becomes air-bubbles and flows into the ink chamber 56 through the connecting hole 65. The air-bubbles, which flow into the ink chamber 56, stay on the surface of the ink (the upper portion of the ink chamber 56). Thus, the ink level also gradually lowers in the ink chamber 56, so that the ink can be continuously supplied to the ink-jet head 24.

When the ink-jet head is not driven, the porous member 54 absorbs the ink stored in the ink chamber 56 by capillary attraction because the ink in the ink chamber 56 contacts the porous member 54 via the connecting hole 65. Accordingly, ink leakage from the ink-jet head 24 can be effectively prevented.

Figure 2:
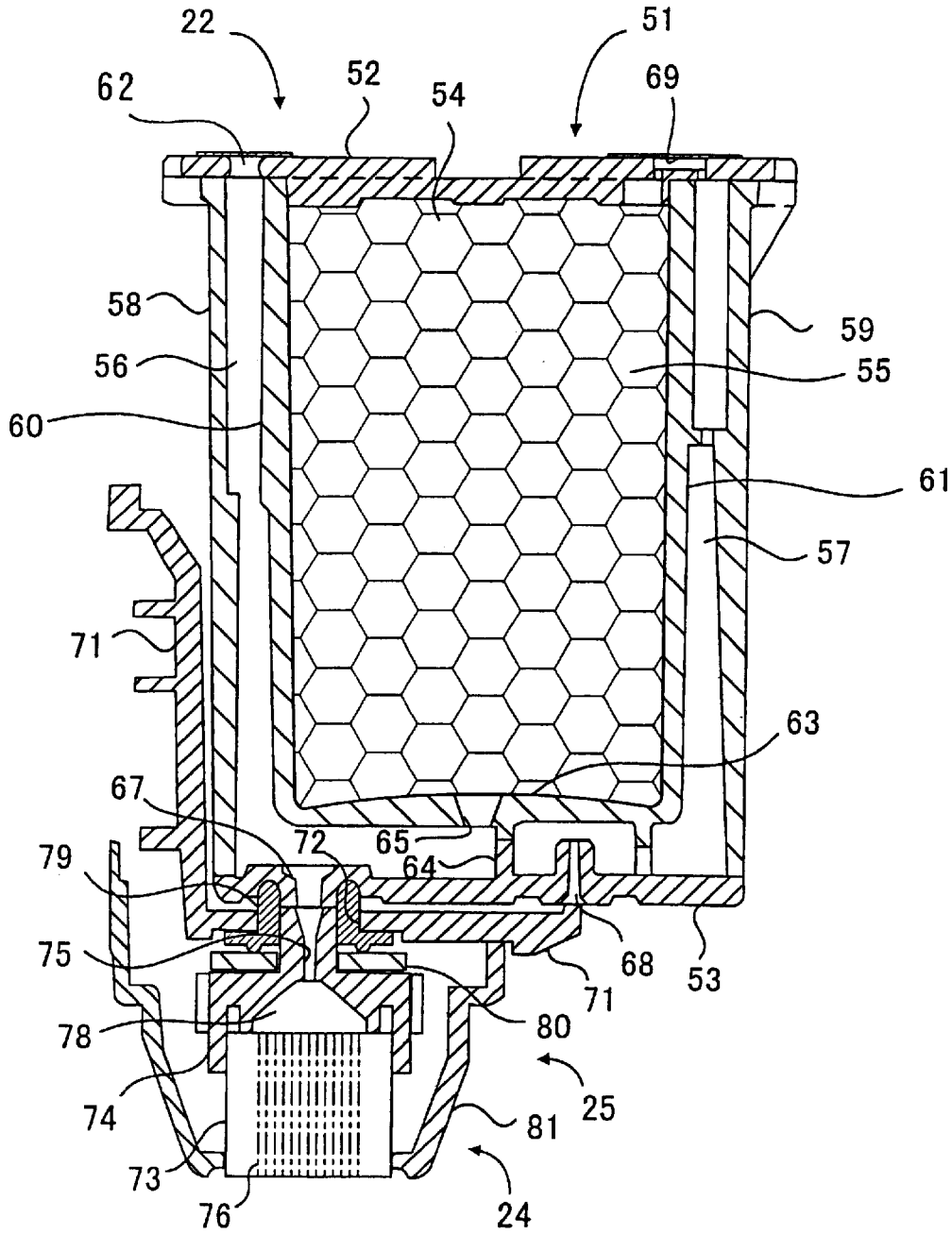
FIG. 2 is a sectional view showing an embodiment of an ink cartridge of the invention.
Figure 3:
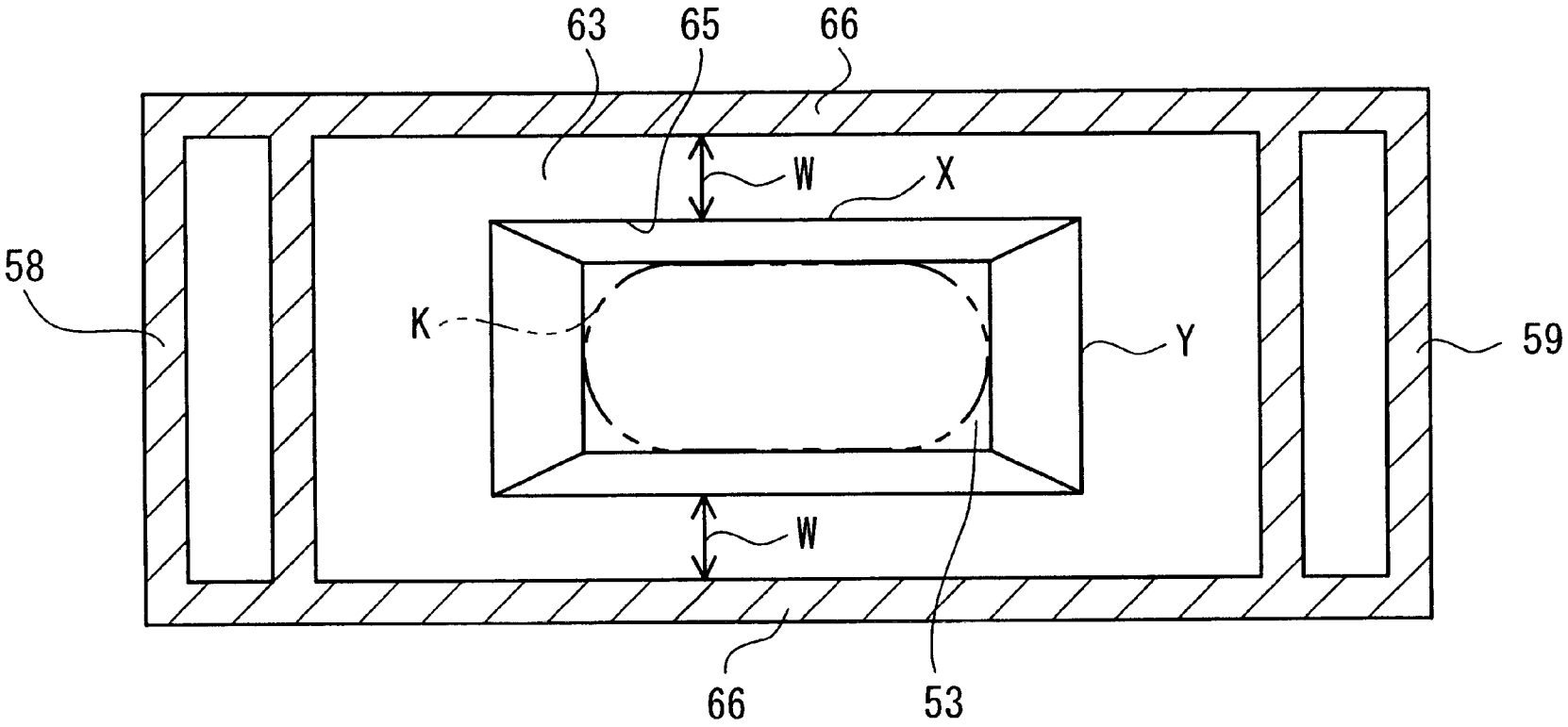
FIG. 3 is a plan view of a connecting hole provided in the ink cartridge of FIG. 2.

As shown in FIG. 2, in the ink cartridge 22, the connecting hole 65 is provided in the middle of the bottom partition wall 63 (substantially centered between the side partition walls 60 and 61). As shown in FIG. 3, the shape in horizontal cross-section of the opening of the connecting hole 65 is a rectangle. The connecting hole 65 is tapered from the porous member storage chamber side to the ink chamber side. More specifically, the connecting hole 65 extends in a direction along a longer side of the bottom partition wall 63. The connecting hole 65 has sides extending along the longer sides of the bottom partition wall 63 (hereinafter, referred to as longer sides X) and sides extending along a direction perpendicular to the longer sides of the bottom partition wall 63 (hereinafter, referred to as shorter sides Y).

The sides X, extending along the longer sides of the bottom partition wall 63, are longer than the sides Y, extending along the shorter sides of the bottom partition wall 63. A ratio of a length between the longer sides X and the shorter sides Y in the connecting hole 65 is substantially equal to a ratio of a length between the longer sides and the shorter sides in the bottom partition wall 63.

The connecting hole 65 is provided in the bottom partition wall 63, at a predetermined distance W, inside in the direction perpendicular to the longer sides of the bottom partition wall 63, from the longer sides of the bottom partition wall 63 (that is, from each inner surface of walls 66 extending in a direction perpendicular to the outer wall sides 58, 59 of the ink cartridge 22). The connecting hole 65 is provided equidistant from the four corners of the bottom partition wall 63.

In the ink cartridge 22, as the ink stored in the ink chamber 56 is supplied to the ink-jet head 24, the air, flowing into the ink chamber 56 from the porous member storage chamber 55 through the connecting hole 65, becomes air-bubbles, and an air-bubble may be trapped in the connecting hole 65. However, the ink cartridge 22 has the connecting hole 65, whose opening is a rectangle in the horizontal cross-section. With this structure, a portion appears in the connecting hole 65, where the air-bubble does not contact the edge of the connecting hole 65. Thus, the connecting hole 65 is not completely occluded by the air-bubble. Therefore, the ink absorbed by the porous member 54 and the ink stored in the ink chamber 56 can always be in contact with each other via the connecting hole 65. Accordingly, the ink stored in the ink chamber 56 can be absorbed by the porous member 54 at all times, thereby effectively preventing ink leakage from the ink-jet head 24.

In the ink cartridge 22, the connecting hole 65 is provided in the middle of the bottom partition wall 63, extending in the direction along the longer sides of the bottom partition wall 63. The ink is likely to remain at corners of the porous member 54 (the corner formed by the side partition wall 60 and the bottom partition wall 63 and the corner formed by the side partition wall 61 and the bottom partition wall 63). However, with the structure of the ink cartridge 22 described above, the ink is easily lead to the connecting hole 65. Thus, the ink can be satisfactorily supplied.

In the ink cartridge 22, the connecting hole 65 is provided in the bottom partition wall 63, at the predetermined distance W inside the walls 66, extending in the direction toward the shorter sides of the bottom partition wall 63, and from the longer sides of the bottom partition wall 63. The porous member 54 cannot make enough contact with the wall at the corners of the porous member storage chamber 55. As a result of this, the resistance of the porous member 54 is reduced so that air-bubbles flow easily into the connecting hole 65 along the edge of the porous member storage chamber 55. However, with this structure, such air-bubbles can be effectively prevented from flowing into and filling the connecting hole 65. Accordingly, occlusion of the connecting hole 65 caused by such air-bubbles can be further effectively prevented.

In the ink cartridge 22, the connecting hole 65 is tapered from the porous member storage chamber side to the ink chamber side and is provided equidistant from the corners of the bottom partition wall 63. The ink cartridge 22 has an ink filling hole 62 in the top cover 52 so as to connect the ink chamber 56. With this structure, when ink is filled into the ink cartridge 22 from the ink filling hole 62, the ink is first filled into the ink chamber 56 and then filled into the porous member storage chamber 55 via the tapered connecting hole 65. Therefore, the ink can be easily distributed over the porous member 54. Further, the connecting hole 65 has a rectangular shape in cross section. Therefore, the rectangular connecting hole 65 can be easily formed when manufacturing the ink cartridge 22. This results in increasing production efficiency of the ink cartridge 22.

Figure 4:
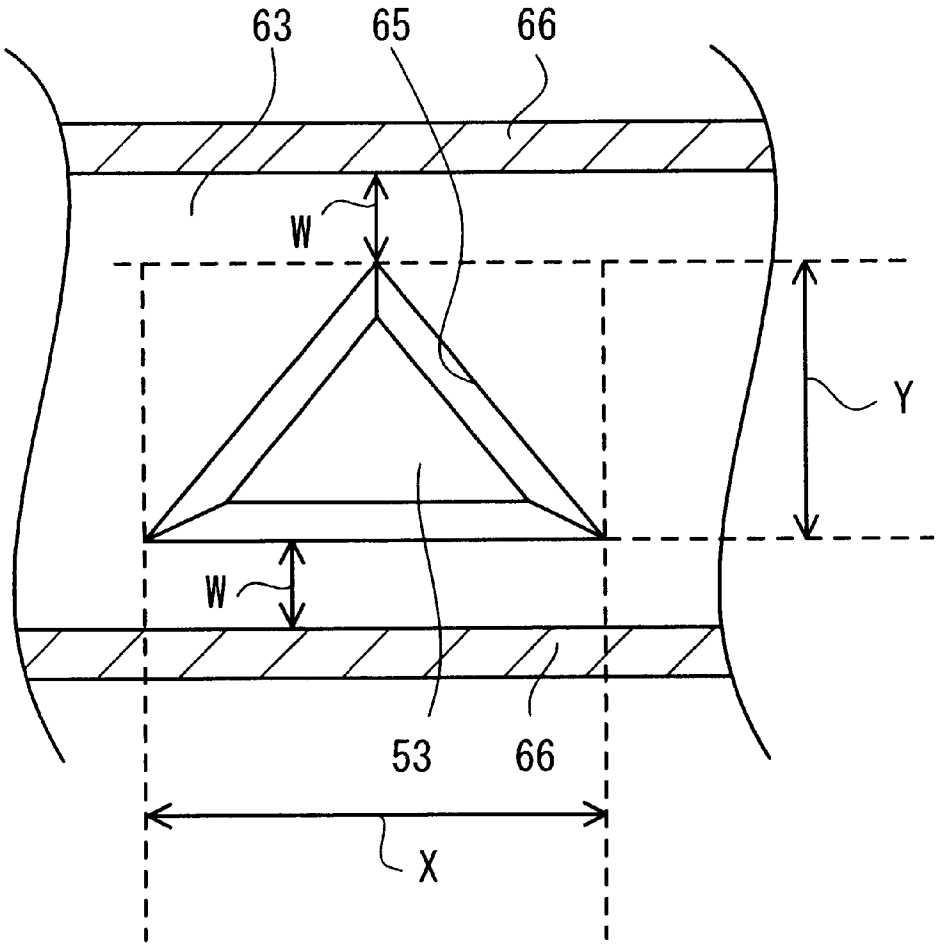
FIG. 4 is a plan view of another embodiment of a connecting hole provided in the ink cartridge of FIG. 2.

In the embodiment described above, the horizontal cross-sectional shape of the opening of the connecting hole 65 of the ink cartridge 22 is a rectangle. In the invention, however, the shape of the opening of the connecting hole 65 is not particularly restricted to a rectangle, so long as the connecting hole 65 is noncircular in cross-section and extends in the direction along the longer sides of the bottom partition wall 63. For example, as shown in FIG. 4, the connecting hole 65 can be triangle in horizontal cross-section. With this structure, the contact area of an air-bubble and the connecting hole 65 can be further reduced. Accordingly, the occlusion of the connecting hole 65 by the air-bubble can be further prevented.

Figure 5:
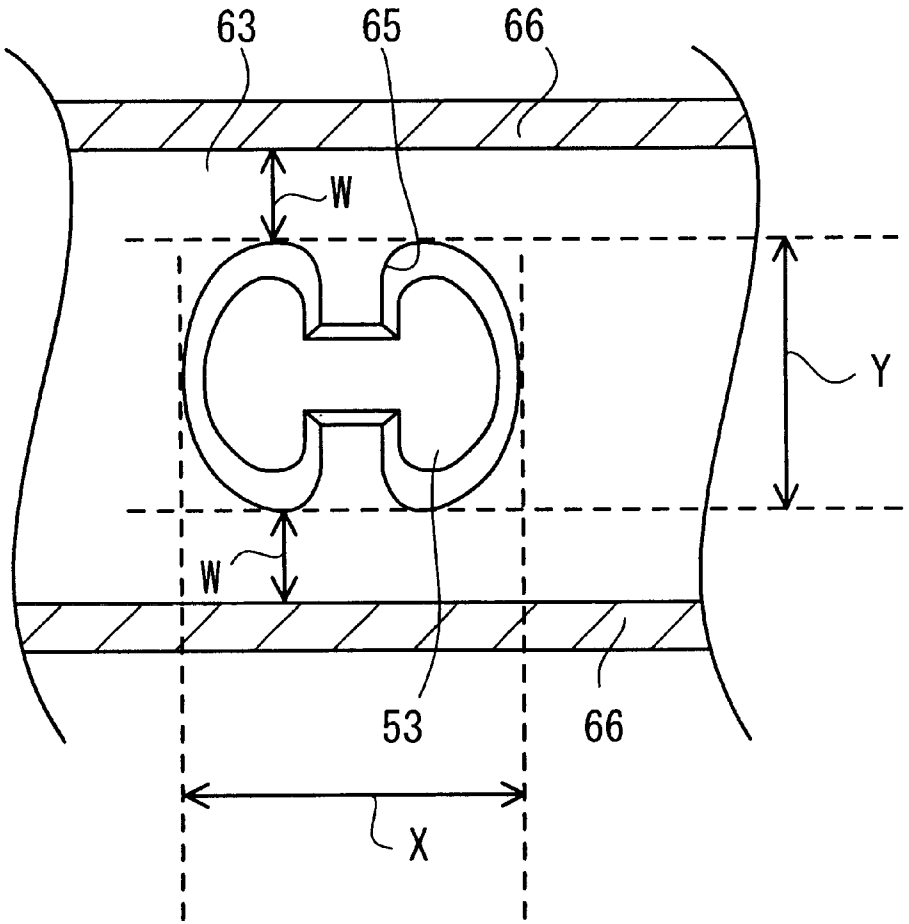
FIG. 5 is a plan view of another embodiment of a connecting hole provided in the ink cartridge of FIG. 2.

Further, as shown in FIG. 5, the connecting hole 65 can have, for example, a substantially H-shape in horizontal cross-section. Further, the connecting hole 65 may have complicated shape. For example, the connecting hole 65 can be shaped like a star.

While the invention has been described in detail with reference to specific embodiments thereof, it will be apparent to those skilled in the art that various changes and modifications can be made therein without departing from the spirit of the invention.

What is claimed is:

1. An ink cartridge for storing ink to be supplied to an ink-jet head, comprising:

a case having a partition wall therein for dividing an inside of the case into a first chamber and a second chamber; and a porous member that is accommodated in the first chamber and impregnated with the ink, wherein the partition wall has a connecting hole that passes through the partition wall in a gravity direction when printing is performed by the ink-jet head, the connecting hole connects the first chamber and the second chamber so that the ink flows from the first chamber, which accommodates the porous member, to the second chamber in the gravity direction, and a cross-sectional shape of an opening of the connecting hole is noncircular in a direction perpendicular to the gravity direction.

2. The ink cartridge according to claim 1, wherein the partition wall has longer sides and shorter sides, the connecting hole is formed substantially at a center of the partition wall, and the connecting hole extends longer in a direction along the longer sides of the partition wall than a direction perpendicular to the longer sides of the partition wall.

3. The ink cartridge according to claim 2, wherein the connecting hole is provided in the partition wall, at a predetermined distance from each of the longer sides of the partition wall, in the direction perpendicular to the longer sides of the partition wall.

4. The ink cartridge according to claim 3, wherein the connecting hole is tapered from the first chamber side to the second chamber side.

5. The ink cartridge according to claim 4, wherein the cross-sectional shape of the opening of the connecting hole is a polygon.

6. The ink cartridge according to claim 4, wherein the cross-sectional shape of the opening of the connecting hole is a triangle.

7. The ink cartridge according to claim 4, wherein the cross-sectional shape of the opening of the connecting hole is a rectangle.

8. The ink cartridge according to claim 7, a ratio of a length between a longer side and a shorter side of the connecting hole is substantially equal to a ratio of a length between a longer side and a shorter side in the partition wall.

9. The ink cartridge according to claim 1, wherein the case has a second partition wall extending from the partition wall to provide a third chamber that communicates with an atmosphere outside the case and also communicates with the first chamber.

10. An ink cartridge for storing ink to be supplied to an ink-jet head, comprising:

a case having a first side wall and a second side wall opposed to the first side wall;

a first partition wall that is disposed substantially parallel to the first side wall of the case;

a second partition wall that is disposed substantially parallel to the first side wall of the case, between the first partition wall and the second side wall;

a third partition wall that is disposed between the first partition wall and the second partition wall, and is joined to ends of the first partition wall and the second partition wall while extending in a direction perpendicular to the first partition wall;

a first chamber that is defined by the first, second and third partition walls;

a second chamber that is defined by the first and the third partition walls; and a porous member that is accommodated in the first chamber and impregnated with the ink, wherein the third partition wall has a connecting hole that passes through the third partition wall in a gravity direction of ink flow, the connecting hole connects the first chamber and the second chamber so that the ink flows from the first chamber, which accommodates the porous member, to the second chamber in the gravity direction and a cross-sectional shape of an opening of the connecting hole is noncircular in a direction perpendicular to the gravity direction.

11. The ink cartridge according to claim 10, wherein the third partition wall has longer sides and shorter sides, the connecting hole is substantially centered between the first partition wall and the second partition wall, and the connecting hole extends longer in a direction along longer sides of the third partition wall than a direction perpendicular to the longer sides of the third partition wall.

12. The ink cartridge according to claim 11, wherein the connecting hole is provided in the third partition wall, at a predetermined distance from the longer sides of the third partition wall, in the direction perpendicular to the longer sides of the third partition wall.

13. The ink cartridge according to claim 12, wherein the connecting hole is tapered inwardly from the first chamber side to the second chamber side.

14. The ink cartridge according to claim 13, wherein the cross-sectional shape of the opening of the connecting hole is a polygon.

15. The ink cartridge according to claim 13, wherein the cross-sectional shape of the opening of the connecting hole is a triangle.

16. The ink cartridge according to claim 13, wherein the cross-sectional shape of the opening of the connecting hole is a rectangle.

17. The ink cartridge according to claim 15, wherein a ratio of a length between a longer side and a shorter side in the connecting hole is substantially equal to a ratio of a length between a longer side and a shorter side of the third partition wall.

18. The ink cartridge according to claim 10, the case further having a fourth partition wall extending from the third partition wall; and a third chamber that communicates with an atmosphere outside the case and also communicates with the first chamber, the third chamber defined by the second and the third partition walls, the fourth partition wall separating the second and the third chambers.

19. An ink cartridge having a pair of opposing side walls, a pair of opposing end walls, a top cover, and a bottom cover, the side walls longer than the end walls, and further comprising:

a pair of opposing partition walls, each partition wall offset from a corresponding end wall and extending transverse to and fixed to the opposing side walls;

a bottom partition wall spaced from the bottom cover and closing a bottom end of an ink storage chamber formed by the pair of opposing side walls, the pair of opposing partition walls, the top cover, and the bottom partition wall, the bottom partition wall having a non-circular opening passing therethrough; and a porous member positioned in the ink storage chamber, wherein ink flows from the ink storage chamber, having the porous member therein, through the non-circular opening in the gravity direction into a further ink storage chamber.

20. The ink cartridge according to claim 19, wherein the opening is substantially centered in the bottom partition wall.

21. The ink cartridge according to claim 20, wherein the opening has inclined walls through the bottom partition wall, the opening in a top surface of the bottom partition wall larger than the opening at a bottom surface.

22. The ink cartridge according to claim 20, wherein the opening is one of a rectangle having a long axis parallel to the opposing side walls, a triangle, a polygon, an ellipse having a long axis parallel to the opposing side walls, and any other complex shape having a non-circular edge.

23. The ink cartridge according to claim 19, wherein the further ink storage chamber is formed by the opposing side walls, an end wall of the pair of opposing end walls, a partition wall of the pair of opposing partition walls, the bottom partition wall, the top cover, and the bottom cover, and ink stored in the ink storage chamber flows through the non-circular opening into the further ink storage chamber.

24. The ink cartridge according to claim 23, further comprising an air chamber formed by the pair of opposing side walls, the other end wall of the pair of opposing end walls, the other partition wall of the pair of partition walls, the bottom partition wall, the top cover, and the bottom cover, the air chamber communicating with an atmosphere outside the ink cartridge and with the ink storage chamber.

* * * * *